US006811465B1

(12) United States Patent
Mavro-Michaelis

(10) Patent No.: US 6,811,465 B1
(45) Date of Patent: Nov. 2, 2004

(54) WORKPIECE GRINDING METHOD WHICH ACHIEVES A CONSTANT STOCK REMOVAL RATE

(75) Inventor: Daniel Andrew Mavro-Michaelis, Leeds (GB)

(73) Assignee: UNOVA U.K. Limited, Buckinghamshire (GB)

( * ) Notice: Subject to any disclaimer, the term of this patent is extended or adjusted under 35 U.S.C. 154(b) by 64 days.

(21) Appl. No.: 10/111,641

(22) PCT Filed: Oct. 26, 2000

(86) PCT No.: PCT/GB00/04126

§ 371 (c)(1),
(2), (4) Date: Apr. 26, 2002

(87) PCT Pub. No.: WO01/30535

PCT Pub. Date: May 3, 2001

(30) Foreign Application Priority Data

Oct. 27, 1999 (GB) ..... 9925367
Oct. 28, 1999 (GB) ..... 9925487

(51) Int. Cl.[7] ..... B24B 49/00; B24B 51/00

(52) U.S. Cl. ..... 451/5; 451/11; 451/62; 451/197; 451/209; 451/210

(58) Field of Search ..... 451/5, 11, 62, 451/57, 58, 195, 197, 209, 210

(56) References Cited

U.S. PATENT DOCUMENTS 4,527,356 A * 7/1985 Ozone et al. ..... 451/239
4,747,236 A * 5/1988 Wedeniwski ..... 451/11
4,848,038 A * 7/1989 Maruyama et al. ..... 451/5
4,885,874 A * 12/1989 Wedeniwski ..... 451/5
4,905,418 A * 3/1990 Wedeniwski ..... 451/5
4,942,695 A * 7/1990 Wedeniwski ..... 451/1
5,251,405 A * 10/1993 Clauss et al. ..... 451/9
5,259,150 A * 11/1993 Himmelsbach ..... 451/62
5,355,633 A * 10/1994 Ishikawa et al. ..... 451/5
5,392,566 A * 2/1995 Wedeniwski ..... 451/5
5,453,037 A * 9/1995 Lehmann ..... 451/5
5,746,643 A * 5/1998 Terasaki et al. ..... 451/5
5,899,797 A * 5/1999 Junker ..... 451/62
5,975,995 A * 11/1999 Hykes et al. ..... 451/62
6,200,200 B1 * 3/2001 Himmelsbach ..... 451/62

* cited by examiner

*Primary Examiner*—M. Rachuba
(74) *Attorney, Agent, or Firm*—Reising, Ethington, Barnes, Kisselle, P.C.

(57) ABSTRACT

In a method of grinding a component such as a cam, a reduction in the finish grinding time is achieved by rotating the component through only a single revolution during a final grinding step and controlling the depth of cut and the component speed of rotation during that single revolution, so as to maintain a substantially constant specific metal removal rate during the final grinding step. The headstock (12) velocity can vary between 2 and 20 rpm during a single revolution of the cam during the final grinding step, with the lower speed used for grinding the flanks and the higher speed used during the grinding of the nose and base of the cam. Using a grinding machine (10) having 17.5 kw of available power for rotating the wheel, and cutting a grinding wheel in the range 80–120 mm diameter, typically the depth of cut lies in the range of 0.25 to 0.5 mm.

12 Claims, 2 Drawing Sheets

WORKPIECE GRINDING METHOD WHICH ACHIEVES A CONSTANT STOCK REMOVAL RATE

FIELD OF THE INVENTION

This invention concerns the grinding of workpieces and improvements which enable grind times to be reduced, relatively uniform wheel wear and improved surface finish on components such as cams. The invention is of particular application to the grinding of non cylindrical workpieces such as cams that have concave depressions in the flanks, which are typically referred to as re-entrant cams.

BACKGROUND TO THE INVENTION

Traditionally a cam lobe grind has been split into several separate increments typically five increments. Thus if it was necessary to remove a total of 2 mm depth of stock on the radius, the depth of material removed during each of the increments typically would be 0.75 mm in the first two increments, 0.4 m in the third increments, 0.08 mm in the fourth, and 0.02 mm in the last increment.

Usually the process would culminate in a spark-out turn with no feed applied so that during the spark-out process, any load stored in the wheel and component was removed and an acceptable finish and form is achieved on the component.

Sometimes additional rough and finish increments were employed, thereby increasing the number of increments.

During grinding, the component is rotated about an axis and if the component is to be cylindrical, the grinding wheel is advanced and held at a constant position relative to that axis for each of the increments so that a cylindrical component results. The workpiece is rotated via the headstock and the rotational speed of the workpiece (often referred to as the headstock velocity), can be of the order of 100 rpm where the component which is being ground is cylindrical. Where a non-cylindrical component is involved and the wheel has to advance and retract during each rotation of the workpiece, so as to grind the non-circular profile, the headstock velocity has been rather less than that used when grinding cylindrical components. Thus 20 to 60 rpm has been typical of the headstock velocity when grinding non-cylindrical portions of cams.

Generally it has been perceived that any reduction in headstock velocity increases the grinding time, and because of commercial considerations, any such increase is unattractive.

The problem is particularly noticeable when re-entrant cams are to be ground in this way. In the re-entrant region, the contact length between the wheel and the workpiece increases possibly tenfold (especially in the case of a wheel having a radius the same, or just less than, the desired concavity), relative to the contact length between the wheel and the workpiece around the cam nose and base circle. A typical velocity profile when grinding a re-entrant cam with a shallow re-entrancy will have been 60 rpm around the nose of the cam, 40 rpm along the flanks of the cam containing the re-entrant regions, and 100 rpm around the base circle of the cam. The headstock would be accelerated or decelerated between these constant speeds within the dynamic capabilities of the machine (c & x axes), and usually constant acceleration/deceleration has been employed.

For any given motor, the peak power is determined by the manufacturer, and this has limited the cycle time for grinding particularly re-entrant cams, since it is important not to make demands on the motor greater than the peak power demand capability designed into the motor by the manufacturer.

Hitherto a reduction in cycle time has been achieved by increasing the workspeed used for each component revolution. This has resulted in chatter and burn marks, bumps and hollows in the finished surface of the cam which are unacceptable for camshafts to be used in modern high performance engines, where precision a nd accuracy is essential to achieve predicted combustion performance and engine efficiency.

The innovations described herein have a number of different objectives.

The first objective is to reduce the time to precision grind components such as cams especially re-entrant cams.

Another objective is to improve the surface finish of such ground components.

Another objective is to produce an acceptable surface finish with larger intervals between dressings.

Another objective is to equalise the wheel wear around the circumference of the grinding wheel.

Another objective is to improve the accessibility of coolant to the work region particularly when grinding re-entrant cams.

Another objective is to provide a design of grinding machine, which is capable of rough grinding and finish grinding a precision, component such as a camshaft, in which the cam flanks have concave regions.

These and other objectives will be evident from the following description.

SUMMARY OF THE INVENTION

According to the present invention, in a method of grinding a component, such as a cam, a reduction in the finish grinding time is achieved by rotating the component through only a single revolution during a final grinding step and controlling the depth of cut and the component speed of rotation during that single revolution, so as to maintain a substantially constant specific metal removal rate during the final grinding step.

The advance of the wheelhead during the final grinding step may be adjusted to produce the desired depth of cut.

Preferably the depth of cut is kept constant but the workpiece speed of rotation is altered during the final grinding step to accommodate any non-cylindrical features of a workpiece so as to maintain a constant specific metal removal rate.

When grinding a cam the headstock velocity may be varied between 2 and 20 rpm during the single revolution of the cam during the final grinding step, with the lower speed used for grinding the flanks and the higher speed used during the grinding of the nose and base of the cam.

During the final grinding step using a grinding machine having 17.5 kw of available power for rotating the wheel, and using a grinding wheel in the range 80–120 mm diameter typically the depth of cut will be in the range of 0.25 to 0.5 mm.

The headstock drive may be programmed to generate a slight overrun so that the wheel remains in contact with the workpiece during slightly more than 360° of rotation of the latter, so as not to leave an unwanted step, hump or hollow at the point where the grinding wheel first engages the component at the beginning of the single revolution of the final grinding step.

During the single revolution of the workpiece the headstock velocity may be further controlled so as to maintain a substantially constant power demand on the wheel spindle drive during the final grinding step so as to reduce chatter and grind marks on the component surface.

When grinding non-cylindrical workpieces, the headstock velocity may be varied to take into account any variation in contact length between the wheel and workpiece during the rotation of the later, which ensures that the material removal rate is maintained truly constant so that all parts of the circumference of the grinding wheel perform the same amount of work, with the result that substantially constant wheel wear results.

Headstock acceleration and deceleration, as well as headstock velocity, may be controlled during the single rotation of the final grinding step, so as to achieve the substantially constant wheel wear.

Where the grinding is to leave at least one concave region around the component profile the grinding is preferably performed using a small diameter wheel, for both rough and finish grinding the component, so that coolant fluid has good access to the region in which the grinding is occurring during all stages of the grinding process, so as to minimise the surface damage which can otherwise occur if coolant fluid is obscured, as when using a larger wheel.

A grinding machine may be used which has two small wheels mounted thereon, either of which can be engaged with the component for grinding. One of the wheels may be used for rough grinding and the other for finish grinding.

A preferred grinding material for the or each grinding wheel is CBN.

A grinding machine adapted to perform a method according to the invention, preferably includes a programmable computer-based control system for generating control signals for advancing and retracting the grinding wheel and controlling the acceleration and deceleration of the headstock drive and therefore the instantaneous rotational speed of the workpiece.

The invention also lies in a computer program for controlling a computer forming part of a grinding machine as aforesaid, in a component when produced by a method according to the invention, or when produced using a machine as aforesaid, and the invention also lies in a grinding machine controlled by a computer-based control system when programmed to perform a grinding method according to the invention.

The invention also lies in a method of grinding a component (whether cylindrical or non-cylindrical) which is controlled by a computer so as to perform a first grinding step in which the wheel grinds the component to remove a relatively large depth of material whilst the component is rotated by the headstock around its axis, with computer control of the headstock velocity at all times during each rotation and with adjustment of the headstock velocity to accommodate any variation in contact length in any region around the component so as to maintain a substantially constant stock removal rate, so that the time for the first grinding step is reduced to the shortest period linked to the power available; and a second step in which the speed of rotation of the component is reduced, and the component is ground to finish size, with the grinding parameters and particularly wheelfeed and headstock velocity being computer controlled so that power demand on the spindle motor does not exceed the maximum power rating for the motor whilst maintaining the same constant stock removal rate during the second step.

The wheelfeed and component rotation speed may be adjusted so that the component reaches final size in one revolution.

The invention relies on the current state of the art grinding machine in which a grinding wheel mounted on a spindle driven by a motor can be advanced and retracted towards and away from a workpiece under programmable computer control. Rotational speed of the wheel is assumed to be high and constant, whereas the headstock velocity, which determines the rotational speed of the workpiece around its axis during the grinding process, can be controlled (again by programmable computer) so as to be capable of considerable adjustment during each revolution of the workpiece. The invention takes advantage of the highly precise control now available in such a state of the art grinding machine to decrease the cycle time, improve the dressing frequency, and wheel wear characteristics, especially when grinding non-cylindrical workpieces such as cams, particularly re-entrant cams.

A reduction in the finish grinding time of a cam is achieved by rotating the cam through only a single revolution during a final grinding step and controlling the depth of cut and the component speed of rotation during that single revolution, so as to maintain a substantially constant specific metal removal rate during the finish grinding step.

The advance of the wheelhead will determine the depth of cut and the rotational speed of the cam will be determined by the headstock drive.

In general it is desirable to maintain a constant depth of cut, and in order to maintain a constant specific metal removal rate requirement for the spindle, the invention provides that the workpiece speed of rotation should be altered during the finish grind rotation to accommodate non-cylindrical features of a workpiece. In one example using a known diameter CBN wheel to grind a camshaft, a finish grind time of approximately 75% of that achieved using conventional grinding techniques can be obtained if the headstock velocity is varied between 2 and 20 rpm during the single finish grind revolution of the cam, with the lower speed used for grinding the flanks and the higher speed used during the grinding of the nose and base circle of the cam.

More particularly and in addition, the depth of cut has been significantly increased from that normally associated with the finish grinding step, and depths in the range of 0.25 to 0.5 mm have been achieved during the single finish grinding step, using grinding wheels having a diameter in the range 80 to 120 mm with 17.5 kw of available grind power, when grinding cams on a camshaft.

The surprising result has been firstly a very acceptable surface finish without a step, bump, hump or hollow, typically found around the ground surface of such a component when higher headstock velocities and smaller metal removal rates have been employed, despite the relatively large volume of metal which has been removed during this single revolution and secondly the lack of thermal damage to the cam lobe surface, despite the relatively large volume of metal which has been removed during this single revolution. Conventional grinding methods have tended to burn the surface of the cam lobe when deep cuts have been taken.

In order not to leave an unwanted bump or hump at the point where the grinding wheel first engages the component at the beginning of the single revolution finish grind, the headstock drive is preferably programmed to generate a slight overrun so that the wheel remains in contact with the workpiece during slightly more than 360° of rotation of the latter. The slight overrun ensures that any high point is removed in the same way as a spark-out cycle has been used to remove any such grind inaccuracies in previous grinding processes. The difference is that instead of rotating the component through one or more revolutions to achieve spark-out, the spark-out process is limited to only that part of the surface of the cam which needs this treatment.

A finish grinding step for producing a high precision surface in a ground component, such as a cam, in accordance with the invention involves the application of a greater and constant force between the grinding wheel and the component during a single revolution in which finish grinding takes place, than has hitherto been considered to be appropriate.

The increased grinding force is required to achieve the larger depth of cut, which in turn reduces the cycle time, since only one revolution plus a slight overrun is required to achieve a finished component without significant spark-out time, but as a consequence the increased grinding force between the wheel and the workpiece has been found to produce a smoother finished surface than when previous grinding processes have been used involving a conventional spark-out step.

In a method of controlling the grinding of a component according to the invention, particularly a non-cylindrical component such as a re-entrant cam, so as to reduce chatter and grind marks on the final finished surface, a significant grinding force is maintained between the wheel and the component up to the end of the grinding process including the finish grinding step, thereby to achieve a significant depth of cut even during the final finish grinding step, and such a force and depth of cut is maintained whilst controlling the headstock velocity so as to maintain a substantially constant power demand on the spindle drive during at least a single finish grind revolution.

By ensuring that the specific metal removal rate is constant the load on the motor will be substantially constant during the whole of the rotation, and power surges that cause decelerations should not occur. As a result even wheel wear should result.

By controlling a grinding machine as aforesaid, it is possible to achieve substantially constant wheel wear during the grinding of non-cylindrical workpieces.

In particular by controlling headstock acceleration and deceleration and headstock velocity during the rotation of a non-cylindrical workpiece, and taking account of the varying contact length between the wheel and workpiece during the rotation of the latter, a further factor can be introduced into the machine control which ensures that the material removal rate is maintained substantially constant so that all parts of the circumference of the grinding wheel perform the same amount of work, with the result that substantially constant wheel wear results. Since the wheel is rotating at many times the speed of rotation of the workpiece, it has previously not been appreciated that the control of the grinding process so as to maintain constant stock removal during a grinding process would beneficially affect wheel wear. However, it has been discovered that by controlling the grinding machine parameters which determine the stock removal rate, so that a substantially constant stock removal rate is achieved during the grinding process of non cylindrical workpieces, taking into account inter alia contact length, wheel wear has been found to be generally uniform and there is less tendency for uneven wheel wear to occur such as has been observed in the past.

This reduces the down time required for dressing the wheel and the frequency of wheel dressings needed to maintain a desired grind quality, and this improves the efficiency of the overall process.

Conventionally, larger grinding wheels have been used for rough grinding and smaller wheels for finish grinding, particularly where the large wheel has a radius which is too great to enable the wheel to grind a concave region in the flank of a re-entrant cam. Proposals have been put forward to minimise the wear of the smaller wheel by utilising the large wheel to grind as much of the basic shape of the cam as possible, including part of the concave regions along the flanks of the cam, and then use the smaller wheel to simply remove the material left in the concave regions, and then finish grind the cam in a typical spark-out mode.

It has been discovered when utilising such a process that the large wheel obscures a region of the concave surface it is generating from coolant fluid so that surface damage can occur during the rough grinding of the concavity when using larger wheels. This has created problems when trying to achieve a high quality surface finish in the concavity by subsequently using a smaller wheel.

Accordingly, the grinding of a component so as to have concave regions is preferably performed using a small diameter wheel to reduce the blinding of the ground surface by the wheel and reduce the damage which can result if coolant is obscured. Two small diameter wheels, typically both the same diameter, one for rough grinding and the other for finish grinding may be used. The two are preferably mounted on the same machine, so that the component can be engaged by the rough grinding wheel at one stage during the grinding process and the other grinding wheel during the finish grinding process. Alternatively two similar wheels may be provided merely to perform the final grinding stage. In either event, the length of contact between the grinding wheel and the component is reduced, particularly in the concave regions of the flanks of a re-entrant cam, so that coolant fluid has good access to the region in which the grinding is occurring at all stages of the grinding process so as to minimise the surface damage which can otherwise occur if coolant fluid is obscured, as compared with using larger grinding wheels.

As employed herein the term "small" as applied to the diameter of the grinding wheels means 200 mm diameter or less, typically 120 mm. 80 mm and 50 mm wheels have been used to good effect.

It has become conventional to employ CBN wheels for grinding components such as camshafts, and since wheels formed from such material are relatively hard, wheel chatter can be a significant problem and the present invention reduces wheel chatter when CBN wheels are employed by ensuring a relatively high grinding force throughout the grinding of the components, as compared with conventional processes in which relatively small depths of cut have characterised the final stages of the grind, so that virtually no force between wheel and component has existed, so that any out of roundness or surface irregularity of the component can set up wheel bounce and chatter.

Results to date indicate that depth of cut should be at least twice and typically 4 to 5 times what has hitherto been considered appropriate for finish grinding, and therefore the force between wheel and component as proposed by the invention is increased accordingly.

When using two small wheels in a two-spindle machine, a preferred arrangement is for the two spindles to be mounted vertically one above the other at the outboard end of a pivoting frame which is pivotable about a horizontal axis relative to a sliding wheelhead. By pivoting the arm up or down so that one or the other of the spindles will become aligned with the workpiece axis, and by advancing the wheelhead to which the frame is pivoted relative to the workpiece axis, so one of the grinding wheels can be advanced towards, or retracted away from the workpiece.

The arm may be raised and lowered using pneumatic or hydraulic drives, or solenoid or electric motor drive.

Where one of the wheels is to be used for rough grinding and the other for finish grinding, it is preferred that the rough grinding wheel is mounted on the upper spindle since such an arrangement presents a stiffer structure in its lowered condition. The stiffer configuration tends to resist the increased forces associated with rough grinding.

A grinding machine for performing these methods requires a programmable computer-based control system for generating control signals for advancing and retracting the grinding wheel and controlling the acceleration and deceleration of the headstock drive and therefore its instantaneous rotational speed and therefore that of the workpiece. A computer program for controlling a computer which forms part of such a grinding machine, is required to achieve each of the grinding processes described herein.

The invention will now be described by way of example with reference to the accompanying drawings, in which.

Figure 1:
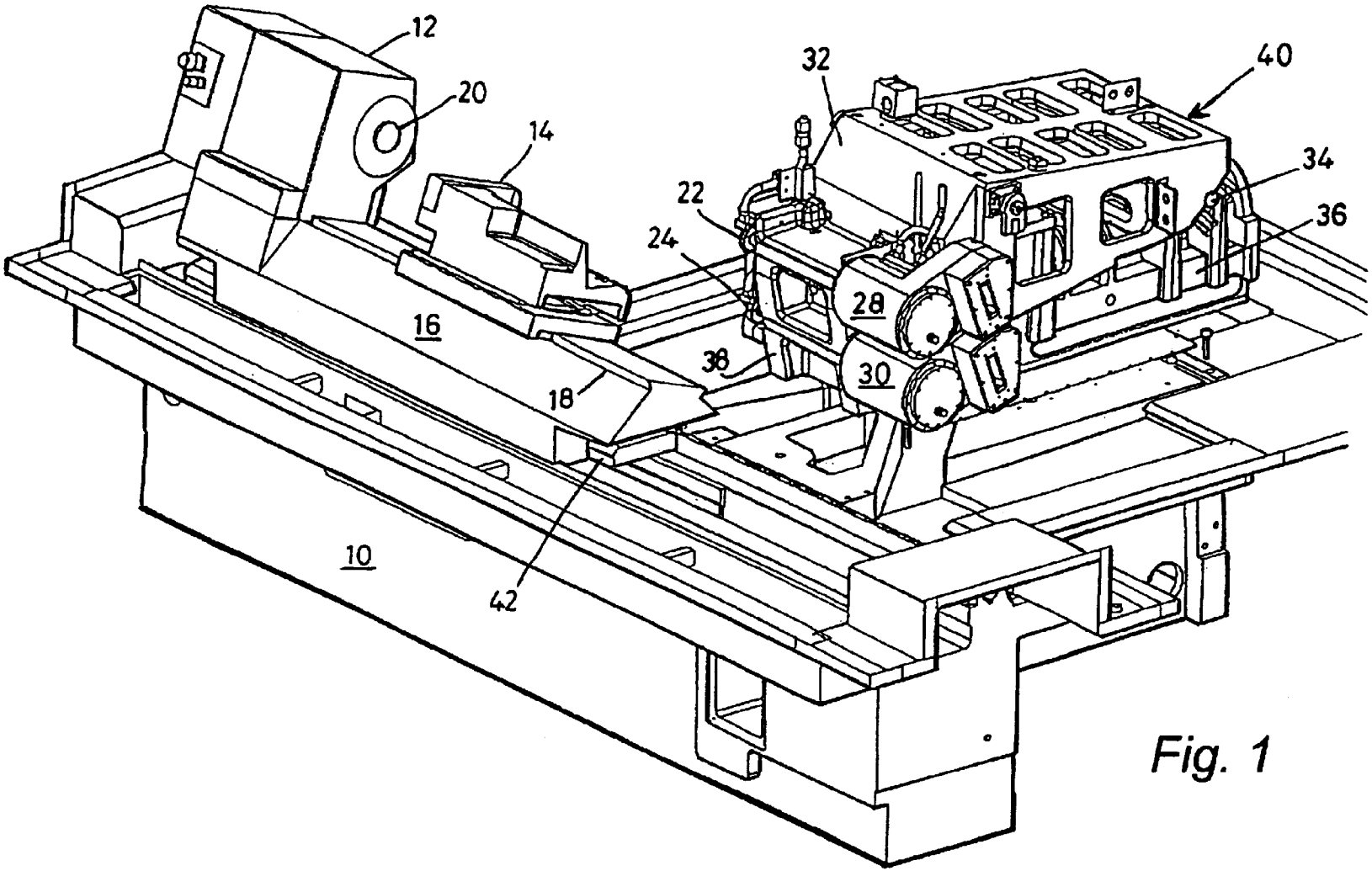
FIG. 1 is a perspective view of a twin wheel grinding machine.

In the drawings, the bed of the machine is denoted by reference numeral 10, the headstock assembly as 12 and the tailstock 14. The worktable 16 includes a slideway 18 along which the headstock 14 can move and be positioned and fixed therealong. The machine is intended to grind cams of camshafts for vehicle engines, and is especially suited to the grinding of cams having concave regions along their flanks. However it could be used with minor modifications, to grind cylindrical components such as crankshafts, and particularly the crankpin of a crankshaft.

A rotational drive (not shown) is contained within the housing of the headstock assembly 12 and a drive transmitting and camshaft mounting device 20 extends from the headstock assembly 12 to both support and rotate the camshaft. A further camshaft supporting device (not shown) extends towards the headstock from the tailstock 14.

Two grinding wheels 22 and 24 are carried at the outboard ends of the two spindles, neither of which is visible but which extend within a casting 26 from the left hand to the right hand thereof, where the spindles are attached to two electric motors at 28 and 30 respectively for rotating the central shafts of the spindles, This transmits drive to the wheels 22 and 24 mounted thereon.

The width of the casting 26 and therefore the length of the spindles is such that the motors 28 and 30 are located well to the right of the region containing the workpiece (not shown) and tailstock 14, so that as wheels 22 and 24 are advanced to engage cams along the length of the camshaft, so the motors do not interfere with the tailstock.

The casting 26 is an integral part of (or is attached to the forward end of) a larger casting 32 which is pivotally attached by means of a main bearing assembly (hidden from view but one end of which can be seen at 34) so that the casting 32 can pivot up and down relative to the axis of the main bearing 34, and therefore relative to a platform 36. The latter forms the base of the wheelhead assembly which is slidable orthogonally relative to the workpiece axis along a slideway, the front end of which is visible at 38. This comprises the stationary part of a linear motor (not shown) which preferably includes hydrostatic bearings to enable the massive assembly generally designated 40 to slide freely and with minimal friction and maximum stiffness along the slideway 38.

The latter is fixed to the main machine frame 10 as is the slideway 42 which extends at right angles thereto along which the worktable 16 can slide.

Drive means is provided for moving the worktable relative to the slide 42, but this drive is not visible in the drawings.

The grinding wheels are typically CBN wheels.

The machine is designed for use with small diameter grinding wheels equal to or less than 200 mm diameter. Tests have been performed using 100 mm and 80 mm wheels. Smaller wheels such as 50 mm wheels could also be used.

Figure 2:
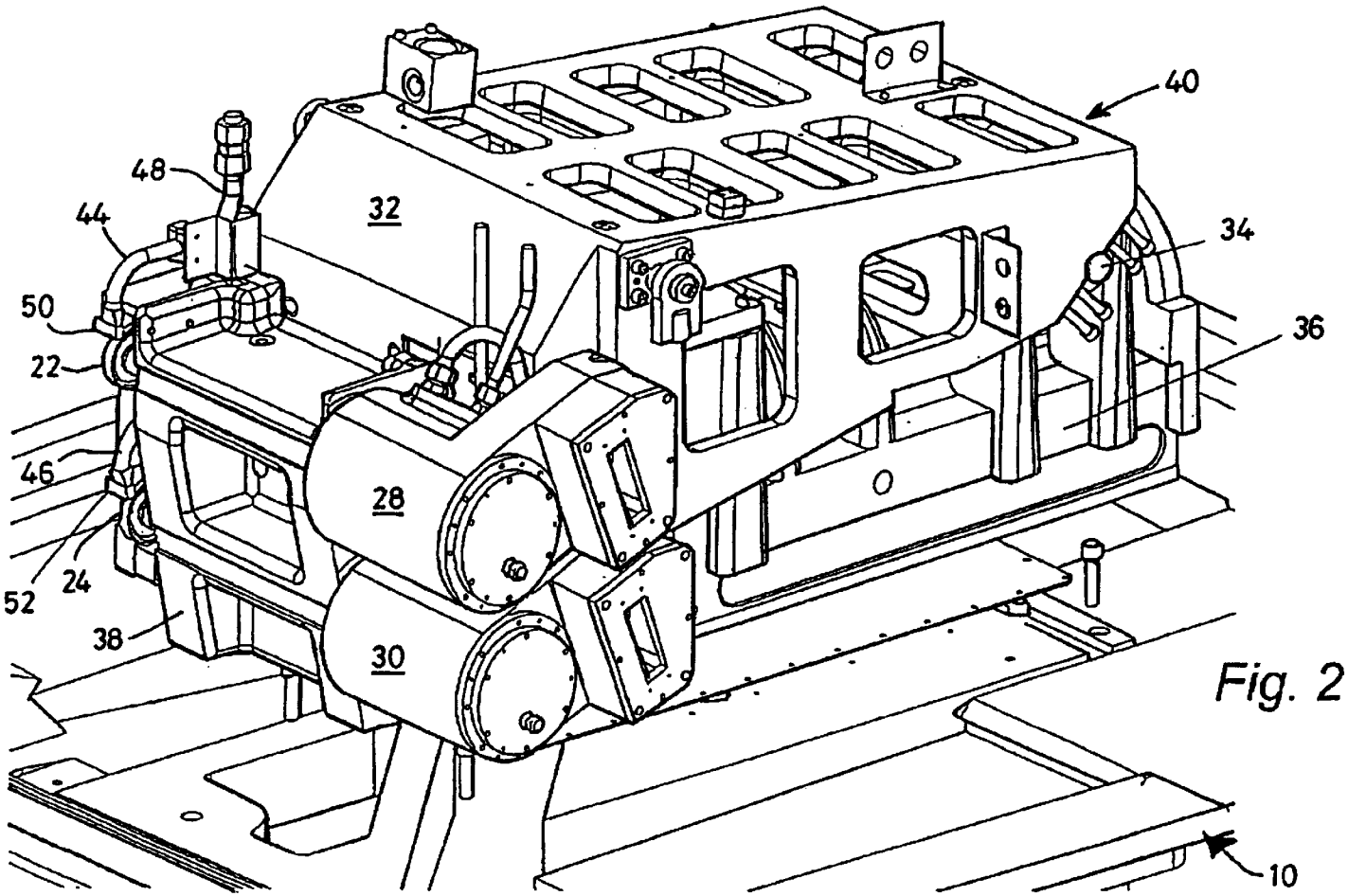
FIG. 2 is an enlarged view of part of the machine shown in FIG. 1.

As better seen in FIG. 2, coolant can be directed onto the grinding region between each wheel and a cam by means of pipework 44 and 46 respectively which extend from a manifold (nor shown) supplied with coolant fluid via a pipe 48 from a pump (not shown).

Valve means is provided within the manifold (not shown) to direct the coolant fluid either via pipe 44 to coolant outlet 50 or via pipe 46 to coolant outlet 52. The coolant outlet is selected depending on which wheel is being used at the time.

The valve means or the coolant supply pump or both are controlled so as to enable a trickle to flow from either outlet 50 or 52, during a final grinding step associated with the grinding of each of the cams.

A computer (not shown) is associated with the machine shown in FIGS. 1 and 2, and the signals from a tacho (not shown) associated with the headstock drive, from position sensors associated with the linear motions of the wheelhead assembly and of the worktable, enable the computer to generate the required control signals for controlling the feed rate, rotational speed of the workpiece and position of the worktable and if desired, the rotational speed of the grinding wheels, for the purposes herein described.

As indicated above, the machine shown in FIGS. 1 and 2 may be used to grind cams of camshafts, and is of particular use in grinding cams which are to have a slightly concave form along one or both of their flanks. The radius of curvature in such concave regions is typically of the order or 50 to 100 mm and, as is well known, it is impossible to grind out the concave curvature using the larger diameter wheels—(usually in excess of 300 mm in diameter), which conventionally have been employed for grinding components such as a camshafts and crankshafts. By using two similar, small diameter grinding wheels, and mounting them in the machine of FIGS. 1 and 2, not only the convex regions, but also any concave regions of the flanks (when needed), can be ground without demounting the workpiece. Furthermore, if appropriate grinding wheels are used (so that rough grinding and finish grinding can be performed by the same wheel), the grinding can be performed without even changing from one wheel to another.

What is claimed is:

1. A method of grinding a non-cylindrical component with a grinding wheel mounted on a wheelhead, comprising the steps of rotating the component through only a single revolution during a final grinding stage, and controlling the depth of cut and varying the speed of rotation of the component so as to achieve a substantially constant specific metal removal rate during said single revolution, wherein the speed of rotation of the headstock is varied to take into account any variation in contact length between the grinding wheel and the component during the rotation of the latter, which ensures that the metal removal rate is maintained truly constant so that all parts of the circumference of the grinding wheel perform the same amount of work, with the result that substantially constant wheel wear results.

2. A method as claimed in claim 1 wherein the advance of the wheelhead during the final grinding stage is adjusted to produce the desired depth of cut.

3. A method as claimed in claim 1 wherein the depth of cut is kept constant.

4. A method as claimed in claim 1 in which the component is a cam having a nose, a base and flanks, the cam being mounted in a headstock, wherein the speed of rotation of the headstock is varied between 2 and 20 rpm during the single revolution of the cam during the final grinding stage, with a lower speed being used for grinding the flanks and a higher speed being used during the grinding of the nose and base of the cam.

5. A method as claimed in claim 1 wherein during the final grinding stage a power of 17.5 kW is available for rotating the grinding wheel, the diameter of the grinding wheel being in the range 80–120 mm, and the depth of cut lying in the range of 0.25 to 0.5 mm.

6. A method as claimed in claim 1 wherein in order not to leave an unwanted step, hump or hollow at the point where the grinding wheel first engages the component at the beginning of the single revolution of the final grinding stage, the headstock drive is programmed to generate a slight overrun so that the wheel remains in contact with the component during slightly more than 360° of rotation of the latter.

7. A method as claimed in claim 1 wherein during said single revolution of the component, the speed of rotation of the headstock is further controlled so as to maintain a substantially constant power demand on the wheel spindle drive during the final grinding stage so as to reduce chatter and grind marks on the component surface.

8. A method as claimed in claim 1, wherein headstock acceleration and deceleration, as well as the speed of rotation of the headstock, are controlled during the single rotation of the final grinding stage, so as to achieve substantially constant wheel wear during grinding.

9. A method as claimed in claim 1 including the step of directing coolant onto the grinding region between the grinding wheel and the component, in which the component has at least one concave region, wherein the grinding is performed using at least one small diameter wheel, for both rough and finish grinding the component, so that coolant fluid has good access to the region in which the grinding is occurring during all stages of the grinding process so as to minimise the surface damage which can otherwise occur if coolant fluid is obscured, as when using a larger wheel.

10. A method as claimed in claim 1 wherein a grinding machine is used which has two small diameter wheels mounted thereon, either of which can be engaged with the component for grinding.

11. A method as claimed in claim 10, wherein one of the two wheels is used for rough grinding and the other for finish grinding.

12. A method as claimed in claim 10 in which the grinding material of the grinding wheel is CBN.

* * * * *

UNITED STATES PATENT AND TRADEMARK OFFICE

CERTIFICATE OF CORRECTION

PATENT NO. : 6,811,465 B1
DATED : November 2, 2004
INVENTOR(S) : Mavro-Michaelis It is certified that error appears in the above-identified patent and that said Letters Patent is hereby corrected as shown below:

Column 2,
Line 10, after "precision" delete "a nd" and insert therein -- and --

Column 8,
Line 22, after "manifold" delete "(nor" and insert therein -- (not --
Line 45, after "order" delete "or" and insert therein -- of --
Line 50, after "such as" delete "a"

Column 10,
Line 29, after "claim" delete "10" and insert therein -- 1 --

Signed and Sealed this

Twenty-second Day of February, 2005

JON W. DUDAS
*Director of the United States Patent and Trademark Office*